US005852256A

United States Patent [19]

Hornig

[11] Patent Number: 5,852,256

[45] Date of Patent: Dec. 22, 1998

[54] NON-FOCUSING ACTIVE WARHEAD

[75] Inventor: Howard C. Hornig, Castro Valley, Calif.

[73] Assignee: The United States of America as represented by the Secretary of the Air Force, Washington, D.C.

[21] Appl. No.: 24,641

[22] Filed: Mar. 16, 1979

[51] Int. Cl.[6] ..... F42B 12/08

[52] U.S. Cl. ..... 102/473; 102/491; 102/493

[58] Field of Search ..... 102/6, 60, 66, 102/87, 90, 334, 364, 473, 491, 493

[56] References Cited

U.S. PATENT DOCUMENTS

| | | | |
|---|---|---|---|
| 2,972,948 | 2/1961 | Kray . | |
| 3,145,656 | 8/1964 | Cook et al. . | |
| 3,217,647 | 11/1965 | Thomanek . | |
| 3,446,748 | 5/1969 | Mallis . | |
| 3,459,129 | 8/1969 | Akhagen | 102/66 X |
| 3,677,182 | 7/1972 | Peterson | 102/66 X |
| 3,830,671 | 8/1974 | McArdle . | |
| 3,888,179 | 6/1975 | Nord et al. | 102/66 X |
| 3,893,814 | 7/1975 | McGhee | 102/66 X |
| 3,898,932 | 8/1975 | Flatau et al. | 102/66 X |
| 3,951,066 | 4/1976 | Schroeder | 102/6 X |
| 4,112,846 | 9/1978 | Gilbert et al. | 102/364 |

*Primary Examiner*—Peter A. Nelson
*Attorney, Agent, or Firm*—Stanton E. Collier

[57] ABSTRACT

A non-nuclear, non-focusing, active warhead that comprises a high explosive charge contained within a casing of reactive metal. When the high explosive is detonated, the reactive metal is dispersed and reacts with the air, which significantly increases the explosive yield of the warhead. The active warhead produces therefore much higher blast effects with significantly reduced weight compared to conventional munitions. The warhead is highly effective against such targets as aircraft which typically have thin fuselages, for example. The explosiveness of this warhead can be enhanced further by elevating the temperature and therefore the reactivity of the reactive metal before or during the explosion. New methods of enhancing the reactivity of the metal are also taught.

12 Claims, 1 Drawing Sheet

NON-FOCUSING ACTIVE WARHEAD

STATEMENT OF GOVERNMENT INTEREST

The invention described herein was made at the Lawrence Livermore Laboratory, with funds from the U.S. Air Force, in the course of or under Contract No. W-7405-Eng-48 between the U.S. Department of Energy and the University of California, and may be manufactured and used by or for the Government for governmental purposes without the payment of any royalty thereon.

BACKGROUND OF INVENTION

This invention relates generally to ammunition and, more particularly, to non-nuclear, non-focusing, explosive devices whose target destruct mechanism relies on high explosive blast effects and high explosive-driven symmetrical dispersal of reactive metal particles and fragments.

Explosive yield and weight are two of the most critical parameters of warheads generally, and blast munitions particularly. The present invention provides a blast explosive whose explosive yield per unit weight surpasses that of all other non-nuclear, non-focused explosives known in the art by a factor of up to 4 or 5.

A key feature of the present device is the use of reactive metal in the casing of the device. By reactive metal we mean a metal which will react rapidly with the medium (e.g., the air) in which the explosion takes place, or with a material which surrounds or is a part of the target. The principal medium for most explosive devices according to the present invention will be the air.

In addition, I have discovered new and unobvious methods of increasing the temperature and therefore the reactivity of the active metal immediately prior to or during the detonation of the warhead. The increased temperature of the active metal accelerates the rate of reaction of the active metal with the air or other target surroundings, thereby significantly increasing the explosiveness of the projectile as a whole.

Reactive metals have been used in non-analogous, special purpose explosives previously. Specifically, liners for shaped charges have been produced from metals which could be considered reactive. Also, so-called self-forging-fragment (SFF) type munitions, which are modified shaped charge munitions have been made using liners comprising metals which can be considered reactive. SFF type munitions are disclosed in Swedish Patent Application No. 16072/66 for "Guided Missile", Stig Yngor Ek, Lars Anders Maltz Lindner, and Knut Göte Jenssen; and Swedish Application No. 16073/66 for "Projectile Having Good Penetration Power, as Well as High Explosive Effect", by the same inventors. Patent applications corresponding to these Swedish applications have also been filed in the United States.

The explosive devices which are the subject of the present invention differ from shaped charge type munitions both in structure and function. The metal liner of shaped charges is basically the source material for forming a hot metallic jet of immense penetration capability. The concave configuration of the explosive charge and the liner are both conducive to forming this hot metal jet. The mechanism of jet formation is basically a hydrodynamic phenomenon, operative in the liner material in bulk form. Self-forming-fragment munitions are similar to shaped charge explosives, in the sense that the metal liner forms a mass of hot metal which is propelled in the direction of a target by the explosive charge, however with a lesser degree of jet formation. Nevertheless, as in the case of conventional shaped charges, the metal forms a relatively cohesive body of hot material propelled away from the point of detonation toward a target, but largely together, as a glob of material. Although these shaped charge type explosive devices may employ reactive metals, they do not derive a meaningful amount of energy from the interaction of the reactive metal with the environment, because the metal moves as a cohesive mass of material. While the degree of interaction with the environment may be greater for reactive metal of SFF type explosive devices, the directionality and concentration of the metal ejected from the explosive limits the amount of energy derived from any metal-air reaction.

By contrast, the present explosive propels and disperses reactive metal over a relatively large space surrounding the point of detonation in relatively finely divided form in order to enhance the metal surface area exposed to and reacting with the medium.

Another class of munitions known in the prior art are the fuel-air explosives. These explosives comprise an air combustible hydrocarbon, such as propane, butane, ethylene oxide, gasoline, or the like, disposed in a suitable tank surrounding a central charge of high explosive. Detonation of this high explosive disperses the hydrocarbon throughout the environment. After a delay which permits the formation of a vapor cloud, the fuel-air mixture is usually ignited by means of a secondary delayed charge.

While this type of explosive may be thought of as deriving a significant part of its energy from the environment, being based on the use of totally different materials, namely liquid hydrocarbons, there are significant limitations in the handling and application of such munitions. These relate to problems stemming from the use of liquids in tanks, which present special hazards relating to leakage, especially upon penetration, and generally the poor strength of tank structure. The explosive devices based on the present metallic reactive materials not only avoid such problems, but also offer many additional desirable features and capabilities, as discussed in detail below.

Fragmentation warhead designs comprise generally a central charge of high explosive surrounded by a relatively heavy (typically steel) outer casing. These fragmentation munitions differ from the present invention in two respects: (1) the metal casing is not reactive, and significantly subtracts from the total mass of high explosive which can be carried by a projectile of a given weight; and (2) all of the explosive yield is derived from a conventional explosive charge which incorporates all of the necessary oxidizer at considerable weight penalty. For example, in the conventional explosive TNT, 60% of the weight is for the oxidizing parts of the molecule.

SUMMARY OF THE INVENTION

In general, the present invention provides a non-nuclear, non-focused blast explosive which comprises a central charge of high explosive surrounded by a casing of a reactive metal capable of chemically interacting with the environment in which the explosion takes place. Upon detonation, the high explosive disperses the reactive metal in the form of relatively fine particles throughout the space in which detonation occurs. This causes the reactive metal to violently and exothermally interact with the environment and multiply the explosive yield of the device.

The invention further provides methods and means for improving the time rate of energy yield from the interaction between the reactive metal and the environment by (1)

enhancing the reactive metal surface area which becomes exposed to the environment after detonation, and (2) increasing the temperature of reactive metal at the time of interaction with the environmental component.

In summary, an objective of this invention is to provide a blast explosive of enhanced energy density per unit weight and volume of explosive.

Another object is to provide an improved explosive for defeating fast moving, low density-large area targets sensitive to blast.

A still further object is to provide an explosive device of improved effectiveness against such targets as large buildings, ships and the like.

Another very important objective is to provide ordnance items of reduced weight.

These principal objects, as well as other related objects of my invention (such as high blast yield in an explosive device of improved penetration capability) will become readily apparent after a consideration of the description of my invention, together with reference to the Figures of the drawings.

DESCRIPTION OF THE PREFERRED EMBODIMENTS

Figure 1:
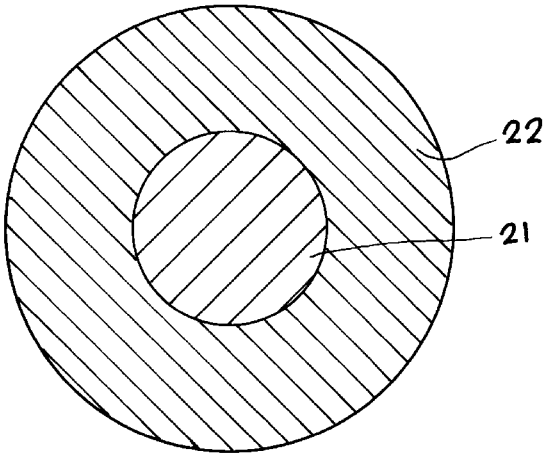
FIG. 1 is a cross sectional schematic view of the present explosive device.

With reference to FIG. 1, therein is shown a non-nuclear, non-focusing, active warhead according to the present invention. The warhead comprises a symmetrically shaped high explosive charge 21; and a casing of reactive metal 22 surrounding the high explosive charge 21. The high explosive, per se, may be any conventional high explosive, such as HMX, RDX, TNT, and the like. The preferred HE is the well known explosive "Composition B" which is 60% RDX and 40% TNT.

Conventional high explosives, including the preferred high explosive suitable for the present explosive devices, are described in detail in the literature, in particular in the Air Force Training Manual TO 11A-1-34 entitled "Military Explosives" , published by the U.S. Department of the Army and the Air Force in 1955.

As a matter of preference, the shapes of the high explosive charge are preferably spherically (such as 21, FIG. 1) or cylindrically (such as 21A, FIG. 2) symmetric, to provide a uniform dispersion pattern. The reactive material component of casing 22 is in general any material that is relatively easy to oxidize, more particularly in the context of the present explosive, the Group 1A, 2A, 3A, 3B metals, including the lanthanides and actinides, as well as Group 4B metals, may be considered reactive materials. In addition, their intermetallic alloys and compounds, their hydrides, silicides, phosphides, and carbides may provide suitable reactive materials. Specific preferred materials are magnesium, aluminum, titanium, zirconium, or cerium metal; intermetallic alloys thereof; or unstable compounds containing metals such as suicides and phosphides. $LiBH_4$, TiH, LiH, and LiAlH have been found to provide especially effective materials for use in casings. Depending on the type of metal used and the configuration of the casing, the amount of reactive metal may be up to 400% of the weight of the high explosive.

Figure 2:
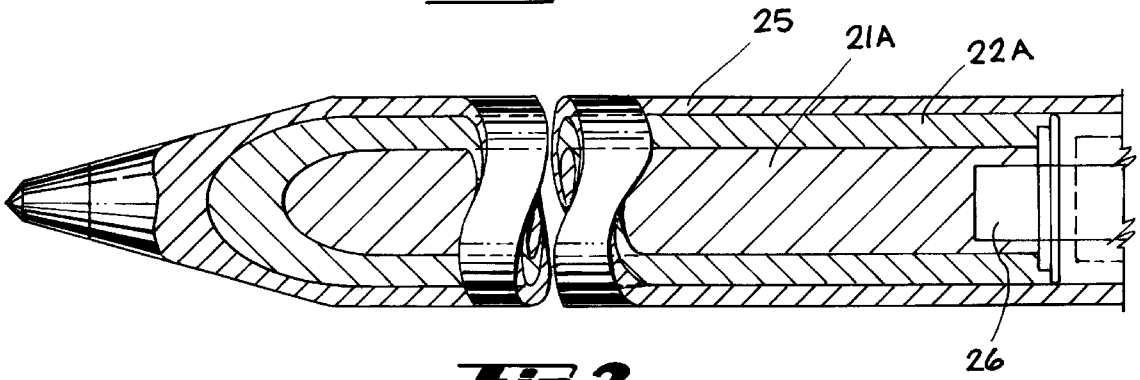
FIG. 2 is a side elevation view, cutaway and partially cross sectioned, of a representative projectile containing the present non-focusing active warhead, enclosed in an outer casing which aids target penetration.

Solid metal casings, such as shown in FIGS. 1 and 2, are typically machined from stock, but can also be manufactured by other methods such as casting or forging. Detonation of the HE tends to form relatively small fragments, per se. However, it is preferred to insure that small fragments are produced by such measures as prescoring, as well as other methods known in the fragmentation munition art which will tend to result in copious production of small fragments. It should be kept in mind that the primary intent is to produce relatively small metal particles in order to expose as large a surface area as possible to the environment to produce energy and blast. However, for certain targets it may be desirable to produce a limited number of larger fragments, indicated by the numberal 44 in FIGS. 3 and 4, of reactive metal, which will travel farther from the point of detonation and extend the volume of the explosion. These fragments may also penetrate certain targets.

Figure 3:
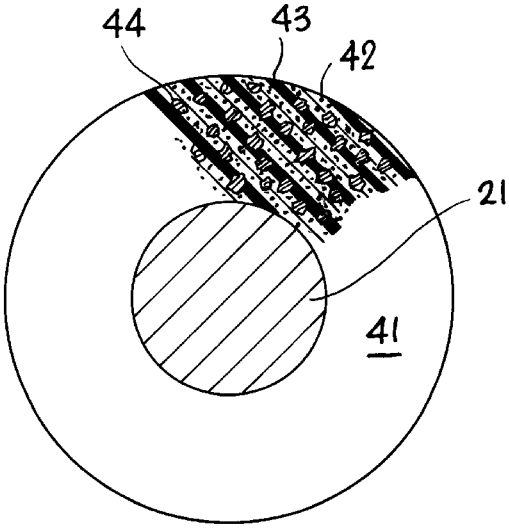
FIG. 3 is a cross sectional view of an active non-focusing explosive with a casing, which comprises powdered reactive metal in a binder matrix.

As will be discussed in greater detail below, particularly effective casing structures are made of reactive material powders disposed in a matrix of polymeric binder materials, rather than from solid metals. Such casing structures offer flexibility in the choice of reactive metal particle sizes incorporated in the matrix. For example, should it be desirable to produce an explosive device which will produce a certain fraction of larger reactive material fragments, an appropriate proportion of such fragments would be incorporated in the casing during manufacture, as indicated in FIG. 3.

It is to be noted that, unlike the prior art, the present active warhead spreads the metal particles out over a symmetrical area after the explosion. Stated another way, the pattern of dispersal is not focused, but uniform in distribution, in order to maximize the interaction between the metal and the environment. It is this feature which maximizes blast effects. Another benefit is that effectiveness against targets is also improved due to better hit and destruction probabilities.

By environment of the detonation, we normally mean the air. In principal, however, the environment could be water or any other material which is abundant in the intended target environment. The reactive metal component is chosen according to its reactivity with respect to this environmental component, and reacts chemically with the reactive material. For example, for an explosive device for submarine applications, casings comprising alkali or alkaline earth metals or compounds reacting vigorously with water could be employed.

The present explosive device may be detonated by means of time, proximity, or impact fuses, indicated by the numeral 26 in FIG. 2, as conventional blast explosives. In any event, the mechanism is the same: the major part of the explosive energy is derived from the reaction of the casing material with the medium in which the explosion takes place, rather than from the high explosive, per se. The large savings on device weight are due to the fact that the necessary oxidizer need not be carried by the explosive device, but is drawn from the environment. The explosive energy yield of the present explosive can be up to five times as great as the yield from conventional explosives of the same weight.

In comparison with the prior art warheads, the present inventive non-focusing active warhead, FIG. 1, results in a relatively high blast, as pointed out above, which makes the warhead especially suitable for use against targets sensitive to blast, such as aircraft, light building structures, vehicles, personnel, and the like. However, the substitution of a reactive metal casing for the conventional higher strength steel casings reduces its penetration capability into stronger targets. The present explosive may, however, also be modified for use against hard structures.

FIG. 2 shows a projectile, outfitted with the present non-focusing active warhead, modified for use against hardened targets such as ships, buildings, and the like, which need to be penetrated by the projectile to achieve the desired destructive effects. To facilitate penetration, the warhead is enclosed in hardened steel casing 25, which protects the munition during impact. Casing 25 is made from conventional materials and by conventional methods well known in the art.

The magnitude of the blast produced depends critically on the total time required for the casing material to complete its reaction with the surrounding medium. It is desirable that the reaction completes in the shortest possible time. One parameter is the particle size which is produced as a result of the initial detonation of the high explosive. As indicated above, casing structures which tend to fragment into smallest size particles are preferred in this regard. It would indeed be desirable to vaporize the casing. As will be discussed later, providing casing structures composed of powdered metals disposed in a binder ensures the production of small particle sizes.

A second important parameter relates to the reactivity of the reactive metal fragments, which is strongly temperature-dependent. In general, the total time required for the reaction between the reactive metal and the environmental medium to run to completion decreases with increasing temperature of the reactants. An important aspect of the present invention is to further enhance the blast effect of the explosive by increasing the temperature of the reactive metal component of the present device prior to or during the explosion.

In general, the present methods for inceasing the reactive metal temperature fall into three categories, as well as variations and combinations thereof.

The first method for heating the reactive material exploits the heat content of the explosive combustion products, which are brought into contact with the casing material. In order to promote this heating mechanism, the explosive is made with the casing abutting against the high explosive charge without intervening materials or barriers, as shown in the Figures.

The second method relates to providing a chemical heat source disposed in heat conductive relation to the reative material. This heat source is initiated in the course of, or just prior to, the detonation of the HE. Several kinds of heat sources may be employed. The first category are chemical fuel-oxidizer mixtures or self-energetic materials, such as propellants and explosives. These heat source materials are ideal for use in binder matrix type of reactive material casings, wherein they may be incorporated simply as an additional ingredient. Where the reactive metal casings are made from solid metals, the heat source may be disposed adjacent to the reactive metal as a liner, or in the form of an alternately layered sandwich casing construction. It should be noted that as a special case, the fuel may be the reactive material itself, and the oxidizer may be incorporated in the binder, or may indeed be the binder itself.

Another kind of chemical heat source involves chemical intermediates exothermally formed by a reaction between two or more reactive materials, which will subsequently combust in the air. An example of such a material is a combination of titanium and boron which will react chemically to form titanium boride at a high temperature. The resulting titanium boride will combust in the air. Again, these materials are ideally suited for binder matrix type casings. The initial shock from the HE detonation causes part of the ingredients to react with each other to form the intermediate. The entire casing is then heated by the exothermic intermediate forming reaction. The remainder of the reactive material and the intermediate then rapidly react with the air to produce the enhanced blast effect.

The third method for increasing the temperature of the reactive materials exploits the fact that solids are strongly heated by compressive shocks. Thus a continuous solid metal casing will be strongly heated by shock and deformation due to HE explosion and/or impact of the projectile on a hard target. Shock heating can be significantly enhanced by providing a casing structure which exhibits void spaces, indicated by the numeral 45 in FIG. 4, because compressive shock heating effects are much more pronounced by void spaces than they are in continuous solids. A suitable range of void space is 5–15% by volume. It should be noted that the shock-heating mechanism is particularly compatible with binder matrix type casings, since the void spaces are readily obtained by a lesser degree of compression of the casing during the manufacturing phase. The void spaces are thus inherently formed by compressing the casing material to less than theoretical densities.

Figure 4:
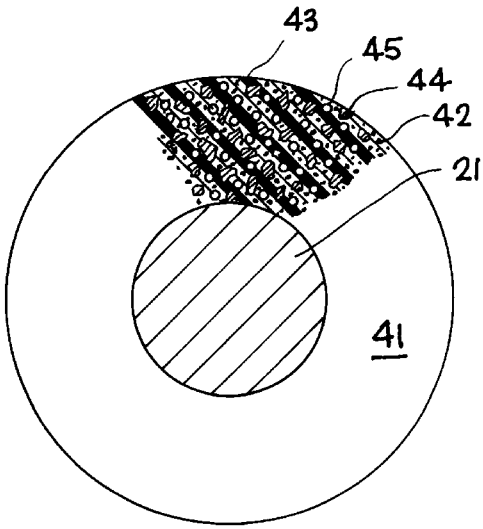
FIG. 4 is a cross sectional view of an active explosive having a porous casing.

FIGS. 3 and 4 show preferred casing structures for accomplishing reactive metal heating in the course of the detonation of the central HE charge.

FIGS. 3 and 4 show an explosive in which the casing 41 is made of reactive metal powder 42 dispersed in a matrix of a plastic binder 43. Such a casing configuration promotes rapid reaction and burn-up of the reactive metal to produce optional explosive yields.

Suitable binder materials are polymeric plastics; however, because they function as oxidizers, fluorocarbons such as Teflon and Viton are preferred, as indicated below. Fluorocarbon liquids or oils, used either alone or as plasticizers in the binder, could also be used. The amount of binder is preferably kept as low as possible, since excess binder contributes to warhead weight at the expense of reactive metal. Five to 10% by weight has been found to provide casings of satisfactory strength. A preferred binder material is a copolymer of vinylidene fluoride and hexafluoropropylene having a composition of $C_5H_{3.5}F_{6.5}$ (such as "Fluorel-1243", which is commercially available from the 3M Company, Minneapolis, Minn., or such as "Viton-A", which is commercially available from the duPont Company, Wilmington, Del.). The preferred reactive metals for use with the Viton-A binder are aluminum and magnesium.

FIG. 4 shows an alternate preferred casing 41, wherein the casing is a porous solid. Upon explosion of the high explosive and/or impact of the projectile on the target, the porous casing becomes strongly heated, and elevates the temperature of the adjacent reactive metal and thereby its reactivity toward the surrounding medium.

Some examples of the increased blast produced by reactive cases or liners of four different reactive materials, compared with control charges of Comp. B, are shown in Table I. The charges were all symmetrical right cylinders 89 mm long. The active warhead charges were all constructed as in FIG. 2, each with a central cylinder of Comp. B explosive surrounded by a case or liner of reactive material, and cased on the outside by a steel tube weighing 60 grams and having a thickness of 0.6 to 0.9 mm, depending on the diameter of the enclosed charge of Comp. B and reactive liner. For five of the charges, the steel outer tubes had the identical size of 32 mm diameter; but slightly larger diameters were required for the other three cased charges.

The charges were suspended in a chamber having a volume of 16 $m^3$. The shock wave overpressure produced by the detonation when the charge was initiated with a detonator was measured by an electrically operated pressure transducer (gage) located 2.6 m from the charge in units of pounds per square inch (psi).

The pressure impulse, i.e., the mathematical product of overpressure multiplied by the time of application, was also determined. The configuration of all components of the firing chamber and location of the charge were exactly the same for all measurements.

The explosive performance was measured as shock wave peak overpressure and impulse. Comparisons are shown with the controls which contain only Comp. B—one charge in a steel tube, one charge bare. Additional calibration measurements with bare Comp. B, only one of which is shown, permitted conversion of each impulse value to an equivalent weight of bare Comp. B, an amount of Comp. B that would produce the same impulse under the same conditions.

The reactive cases or liners were machined tubes that closely matched the size of both the explosive core and the outer steel case. Three of the liner materials were made of finely powdered metals: aluminum, titanium, and an alloy of magnesium and aluminum containing 50 weight per cent of each metal. The powdered metals were coated with Viton, compacted to dense solids, and machined into the desired cylinders. Magnesium liners were cylinders machined from commercial magnesium bar stock.

The first group of examples show that replacement of Comp. B with reactive material in a fixed-size steel tube increases the peak overpressure and impulse of the air shock wave, compared to the control of a tube filled with Comp. B alone; the corresponding equivalent weight of bare Comp. B is more than doubled by the use of the powdered metals. The second group of examples show that the addition of reactive material to a fixed amount of Comp. B increases the air shock peak overpressure and impulse substantially; the corresponding equivalent weight of bare Comp. B is approximtely three times that of the control of the same weight of Comp. B alone in an equivalent steel case.

Specific parameters of resulting actual experiments are shown in the Table below:

TABLE

Examples of Active Warheads and Their Air Blast Performance

| | Charges/Identical Steel Cases | | | | | Charges/Equal Wt. Comp. B. | | | |
|---|---|---|---|---|---|---|---|---|---|
| | Al/Vit 93/7 | Mg Al/ Vit 89/11 | Ti/Vit 96/4 | Mg bar 100 | None, Control | Al/Vit 93/7 | Mg Al/ Vit 89/11 | Mg bar 100 | None, Control |
| Liner wt., g | 53 | 42 | 65 | 21 | None | 43 | 44 | 113 | None |
| Comp. B wt., g | 64 | 59 | 70 | 78 | 100 | 100 | 100 | 100 | 100 |
| Steel case dia., mm (60 g each) | 32 | 32 | 32 | 32 | 32 | 37 | 37 | 44 | None |
| Overpressure peak, psi | 18.5 | 13.5 | 14.8 | 9.4 | 7.9 | 18.0 | 19.0 | 12.4 | 10.0 |
| Impulse, m psi's | 1.4 | 1.3 | 1.1 | 0.7 | 0.4 | 1.6 | 1.6 | 1.8 | 0.5 |
| Equivalent wt. of bare Comp. B for same impulse, g | 218 | 205 | 183 | 124 | 84 | 250 | 250 | 286 | 100 |

It is to be noted that, although there have been described the fundamental and unique features of my invention, as applied to a particular preferred embodiment and as set forth in variations of an inventive method, it is to be understood that various substitutions, omissions, and adaptations can be made by those of ordinary skill in the art without departing from the spirit of my invention.

What is claimed is:

1. A non-nuclear, non-focused blast explosive device comprising a central charge of high explosive enclosed in a continuously convex casing made of material which exhibits substantial reactivity with respect to a component of the environment in which said blast explosive is to be detonated, wherein said casing is made of a continuous metallic body of aluminum, magnesium, titanium, zirconium, or cerium.

2. A non-nuclear, non-focused blast explosive device comprising a central charge of high explosive enclosed in a continuously convex casing made of material which exhibits substantial reactivity with respect to a component of the environment in which said blast explosive is to be detonated, wherein said casing material is selected from the group of powdered metals consisting of aluminum, magnesium, titanium, lithium hydride, zirconium, and cerium dispersed in a polymeric binder matrix.

3. A non-nuclear, non-focused blast explosive device comprising a central charge of high explosive enclosed in a continuously convex casing made of material which exhibits substantial reactivity with respect to a component of the environment in which said blast explosive is to be detonated, wherein said reactive material comprises a reactive metal, and said reactive metal casing is made of aluminum, and of a copolymer of vinylidene fluoride and hexafluoropropylene having a composition of $C_5H_{3.5}F_{6.5}$.

4. A non-nuclear, non-focused blast explosive device comprising a central charge of high explosive enclosed in a continuously convex casing made of material which exhibits substantial reactivity with respect to a component of the environment in which said blast explosive is to be detonated, wherein:

a. said reactive material is a reactive metal selected from the group consisting of Group 1A, 2A, 3A, 3B metals, including the lanthanides and actinides, Group 4B metals and intermetallic alloys and compounds thereof, wherein said intermettalic compounds are selected from the group consisting of hydrides, silicides, phosphides, and carbides thereof; and b. said reactive metal is disposed in a copolymer of vinylidene fluoride and hexafluoropropylene having a composition of $C_5H_{3.5}F_{6.5}$.

5. A non-nuclear, non-focused blast explosive device comprising a central charge of high explosive enclosed in a continuously convex casing made of material which exhibits substantial reactivity with respect to a component of the environment in which said blast explosive is to be detonated, wherein said reactive material comprises a reactive metal, and said reactive metal casing is made of aluminum, magnesium, and of a copolymer of vinylidene fluoride and hexafluoropylene having a composition of $C_5H_{3.5}F_{6.5}$.

6. A non-nuclear, non-focused blast explosive device comprising a central charge of high explosive enclosed in a continuously convex casing made of material which exhibits substantial reactivity with respect to a component of the environment in which said blast explosive is to be detonated, wherein said blast explosive device is at least enclosed in an outer metal jacket for improved hard-structure penetration.

7. A non-nuclear, non-focused blast explosive device comprising a central charge of high explosive enclosed in a continuously convex casing made of material which exhibits substantial reactivity with respect to a component of the environment in which said blast explosive is to be detonated, wherein said reactive material comprises a reactive metal, and wherein said central charge of high explosive comprises means for heating said reactive metal to elevate its temperature prior to its reaction with said component of said environment.

8. The explosive device, as set forth in claim 2, further defined in that said polymeric binder is porous.

9. The explosive of claim 7, further defined in that said means for heating said reactive metal is a chemical oxidizer disposed proximate to said reactive metal.

10. The explosive of claim 7, further defined in that said means for heating said reactive metal is a mixture of an oxidizer and a powdered fuel, disposed in heat conductive relation to said reactive metal, and means for initiating the reaction between said oxidizer and powdered fuel.

11. The explosive of claim 10, further defined in that means for heating said reactive metal comprises a mixture of reactants capable of forming a shock-sensitive intermediate proximate to said reactive metal.

12. The explosive of claim 7, further defined in that casing comprising said reactive metal has a porous structure in heat-conductive relation to said reactive metal, said porous structure being capable of being heated in response to a shock wave permeating said casing.

* * * * *